US011536033B2

(12) United States Patent
Lowe

(10) Patent No.: US 11,536,033 B2
(45) Date of Patent: Dec. 27, 2022

(54) INTERLOCKING ROOFING PANEL SYSTEM AND METHOD

(71) Applicant: Englert, Inc., Perth Amboy, NJ (US)

(72) Inventor: Robert Benton Lowe, Lanoka Harbor, NJ (US)

(73) Assignee: Englert, Inc., Perth Amboy, NJ (US)

( * ) Notice: Subject to any disclaimer, the term of this patent is extended or adjusted under 35 U.S.C. 154(b) by 0 days.

(21) Appl. No.: 17/198,702

(22) Filed: Mar. 11, 2021

(65) Prior Publication Data

US 2021/0285218 A1 Sep. 16, 2021

Related U.S. Application Data

(60) Provisional application No. 62/989,203, filed on Mar. 13, 2020.

(51) Int. Cl.
*E04D 3/362* (2006.01)
*E04D 3/16* (2006.01)

(52) U.S. Cl.
CPC ..... *E04D 3/362* (2013.01); *E04D 3/16* (2013.01)

(58) Field of Classification Search
CPC .. E04D 3/16; E04D 3/30; E04D 3/361; E04D 3/362; E04D 3/363; E04D 1/2918; E04D 1/2921; E04D 1/2942; E04D 3/364
See application file for complete search history.

(56) References Cited

U.S. PATENT DOCUMENTS 453,743 A * 6/1891 Heller ..... E04D 3/30 52/522
978,834 A * 12/1910 Bonness ..... E04D 3/362 52/531
1,519,350 A 12/1924 Belding
2,565,610 A * 8/1951 Kinghorn ..... E04D 3/363 52/522
3,269,075 A 8/1966 Marini et al.
3,430,395 A 3/1969 Lashkow
4,185,436 A * 1/1980 Vallee ..... E04D 1/30 52/518
4,218,857 A * 8/1980 Vallee ..... E04D 1/18 52/94

(Continued)

FOREIGN PATENT DOCUMENTS

DE 6943325 U 4/1970
DE 102004042055 A1 * 6/2005 ..... E04D 3/362

(Continued)

OTHER PUBLICATIONS

Horizon Loc Installation Details Aug. 2018 downloaded from https://www.centralstatesmfg.com/wp-content/uploads/GUID_INSTL_HorizonLoc.pdf, 32 pgs.

(Continued)

*Primary Examiner* — Christine T Cajilig
(74) *Attorney, Agent, or Firm* — Fredrikson & Byron, P.A.

(57) ABSTRACT

An interlocking panel system for covering a base surface with interlocking panels to prevent water ingress. A first panel is secured to the base surface. A second panel interlocks with the first panel via a hook portion on the second panel entering a receptacle of the first panel. The hook portion expands after entering a retaining portion of the receptacle, thereby preventing the hook portion of the second panel from being withdrawn from the first panel.

26 Claims, 5 Drawing Sheets

(56) References Cited

U.S. PATENT DOCUMENTS

| | | | | |
|---|---|---|---|---|
| 4,356,673 | A | 11/1982 | Gailey | |
| 4,382,354 | A | 5/1983 | Gailey et al. | |
| 4,602,469 | A | 7/1986 | Nuckel | |
| 4,694,628 | A * | 9/1987 | Vondergoltz | E04D 3/363 52/520 |
| 4,982,543 | A | 1/1991 | Boyd | |
| 5,012,623 | A * | 5/1991 | Taylor | E04D 3/362 52/478 |
| 5,349,801 | A | 9/1994 | Verbofsky | |
| 5,519,974 | A | 5/1996 | Greenberg | |
| 5,685,117 | A | 11/1997 | Nicholson | |
| 6,155,006 | A | 12/2000 | Mimura et al. | |
| 6,354,045 | B1 | 3/2002 | Boone et al. | |
| D538,948 | S | 3/2007 | Thimons et al. | |
| 9,267,289 | B2 * | 2/2016 | Vander Laan | E04D 1/265 |
| 9,605,432 | B1 | 3/2017 | Robbins | |
| 2006/0059831 | A1 | 3/2006 | Dombek et al. | |
| 2007/0144097 | A1 | 6/2007 | Saarenko et al. | |
| 2010/0132275 | A1 | 6/2010 | Stanger | |
| 2010/0186334 | A1 | 7/2010 | Seem | |
| 2014/0250815 | A1 | 9/2014 | Vander Laan et al. | |
| 2016/0145872 | A1 | 5/2016 | Anderson et al. | |

FOREIGN PATENT DOCUMENTS

| | | | | |
|---|---|---|---|---|
| FR | 1330174 | A | 6/1963 | |
| FR | 2845710 | A1 | 4/2004 | |
| GB | 896611 | A | 5/1962 | |
| GB | 2274291 | A | 7/1994 | |
| WO | 8600363 | A1 | 1/1986 | |
| WO | WO-2019097107 | A1 * | 5/2019 | E04D 1/2942 |

OTHER PUBLICATIONS

International Patent Application No. PCT/US2021/021876, International Search Report and Written Opinion dated Jun. 9, 2021, 10 pages.

International Patent Application No. PCT/US2021/054539, International Search Report and Written Opinion dated Jan. 27, 2022, 14 pages.

* cited by examiner

INTERLOCKING ROOFING PANEL SYSTEM AND METHOD

CROSS-REFERENCE TO RELATED APPLICATION

This application claims the benefit of U.S. Provisional Application No. 62/989,203, filed Mar. 13, 2020, the content of which is hereby incorporated by reference in its entirety.

TECHNICAL FIELD

This disclosure relates to roofing panels, and in particular, to interlocking roofing panels that may be composed of metal.

BACKGROUND

Because of their exposure to the elements, roofs are provided with weather proofing to prevent damage to the underlying interior structure. On residential buildings in particular, the roof is provided with a predetermined pitch to allow moisture to run off the roof. Secured to the roof are shingles or panels, which are overlapped in accordance with the pitch of the roof to shed moisture and/or water off of the roof. A variety of materials are used for roofing shingles and panels such as, metal, wood, and petroleum-based materials. Typically, a roof will also contain a water barrier layer beneath the roof shingles and/or panels such as tar paper, to protect the roof so that the water does not enter the interior of the building.

Some metal roofing structure include, for instance, long metal panels that extend from a roof ridge all the way to the eves of a roof. These roofing panels may be connected together along their edges with standing seams or they may be attached to a roof deck with overlapping ridges along their edges.

In recent years, decorative metal roofing panels that, when assembled, resemble other traditional types of roofing have become popular. For example, decorative metal roofing panels that resemble cedar shakes, barrel shingles, or slate shingles are among the available choices for consumers. Although popular, decorative roofing panels have suffered from a variety of problems for installers and homeowners including difficult installation, susceptibility to wind and water penetration once installed, objectionable brakes in geometry, and ship lapped ends susceptible to water leakage.

In a typical roofing installation, roof shingles and/or panels are installed beginning at the lowest point of the roof and extending out over the bottom edge of the roof. The shingles are mounted in rows or courses with the side edge of each shingle proximate the adjacent shingle. The shingles in any one row are not connected together nor are they overlapping each other, and fasteners, generally nails, are used to attach the shingles to the roof. Subsequent rows or courses of shingles generally are arranged to overlap the shingles in the immediately lower rows.

SUMMARY

In general, this disclosure relates to an interlocking panel system for covering a base surface. The system comprises a first panel and a second panel. The first panel is configured to cover the base surface and comprises a receptacle. The receptacle further comprises an entry portion and a retaining portion separated by a shoulder, wherein the retaining portion is wider than the entry portion. The second panel is configured to cover the base surface and comprises a hook portion configured to be inserted into the receptacle of the first panel. The hook portion is compressed upon entering the entry portion of the receptacle and subsequently expands upon passing the shoulder of the receptacle into the retaining portion of the receptacle. Thereafter, the hook portion is prevented from being withdrawn from the retaining portion, thereby securing the second panel to the first panel. This system can be installed more quickly and easily than traditional shingles and allows for installation of the panels from a peak of a structure to an eave of a structure.

This disclosure also related to a method of installing panels which can interlock with each other. The method comprises securing a first panel to a base surface. The first panel comprising a receptacle, which further comprises an entry portion and a retaining portion separated by a shoulder. The retaining portion is wider than the entry portion. The method further comprises securing a second panel to the first panel by inserting a hook portion of the second panel into the receptacle of the first panel. When the hook portion is inserted into the receptacle, the hook portion is compressed upon entering the entry portion of the receptacle. The hook portion is subsequently released upon passing the shoulder and entering the retaining portion of the receptacle, thereby causing the hook portion to be prevented from being withdrawn from the retaining portion. Thus, the second panel is secured to the first panel.

DETAILED DESCRIPTION

The following detailed description is exemplary in nature and is not intended to limit the scope, applicability, or configuration of the invention in any way. Rather, the following description provides some practical illustrations for implementing embodiments of the present invention. Examples of constructions, materials, and/or dimensions are provided for selected elements. Those skilled in the art will recognize that many of the noted examples have a variety of suitable alternatives.

Figure 1:
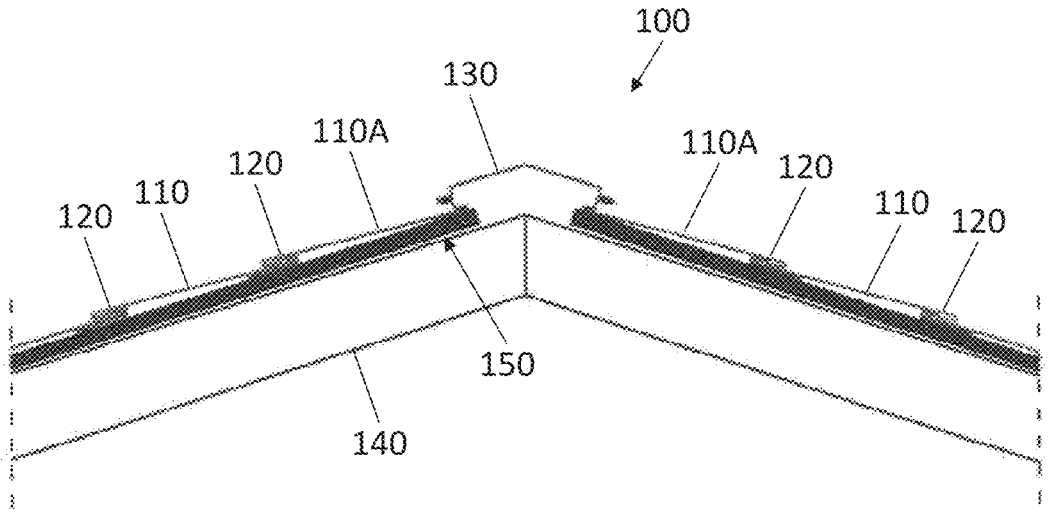
FIG. 1 is a cross-sectional view of an example sloped roof with a number of roofing panels according to the present disclosure attached.

FIG. 1 is a cross-sectional view of an example roof 100 with panels 110. The roof 100 has a support structure 140 and a base surface 150. Base surface 150 is coupled to the support structure 140 and can provide a generally planar surface which slopes downward from a peak of the roof 130. The slope of the roof can be substantially horizontal, substantially vertical, or any slope therebetween. In some examples, base surface 150 can include multiple layers of material. In such examples, base surface 150 can includes a first layer of wood (e.g. oriented strand board/plywood) coupled to a support structure 140 with layers further coupled on top of the first layer of wood. In some examples, the layers can include, insulation, tar paper, a vapor barrier, felt underlayment, nailing planks, a drip edge, and sheathing. One having skill in the art will understand that other layers can be used for base surface 150 and that any combination of layers can be used in any order.

Continuing with the example of FIG. 1, panels 110 are secured to each other by couplings 120 that provide interconnection between at least two panels 110. Panels 110 can be made from metal, such as aluminum, steel, or other alloys, or can be made from other materials such as plastics or wood. One example advantage of using metal for panels 110 is that metal can provide a more durable roof surface that can better withstand stronger winds and other weather events, especially when compared to traditional asphalt shingles. In some examples, panels 110 can have a textured surface. The textured surface can have many designs and, in some examples, can make the panels 110 appear to resemble traditional shingles. In some examples, each of panels 110 can be made from a single sheet of ridged material, such as metal, which can extend laterally across an entire roof, from one horizontal edge of a roof to another, thereby reducing the number of seems between panels. Reducing the number of seems can reduce the number of points of ingress for moisture, which can further protect the base surface 150 and the rest of the house from water damage. Additionally, reducing the number of seems can reduce the number of couplings 120 needed, which can allow for easier and faster installation of the panels 110.

In the example of FIG. 1, panels 110A, proximate to the peak of the roof 130, are coupled to the peak of the roof 130. The peak of the roof 130 can be a ridge cap which, like the panels, can be made of metal and resist water. In some examples, couplings 120 and the coupling between the peak of the roof 130 and panels 110A are designed to resist water from penetrating the coupling, thereby preventing the exposure of the base surface 150 to water. This can have the benefit of preventing water from leaking through the roof 100.

Figure 2:
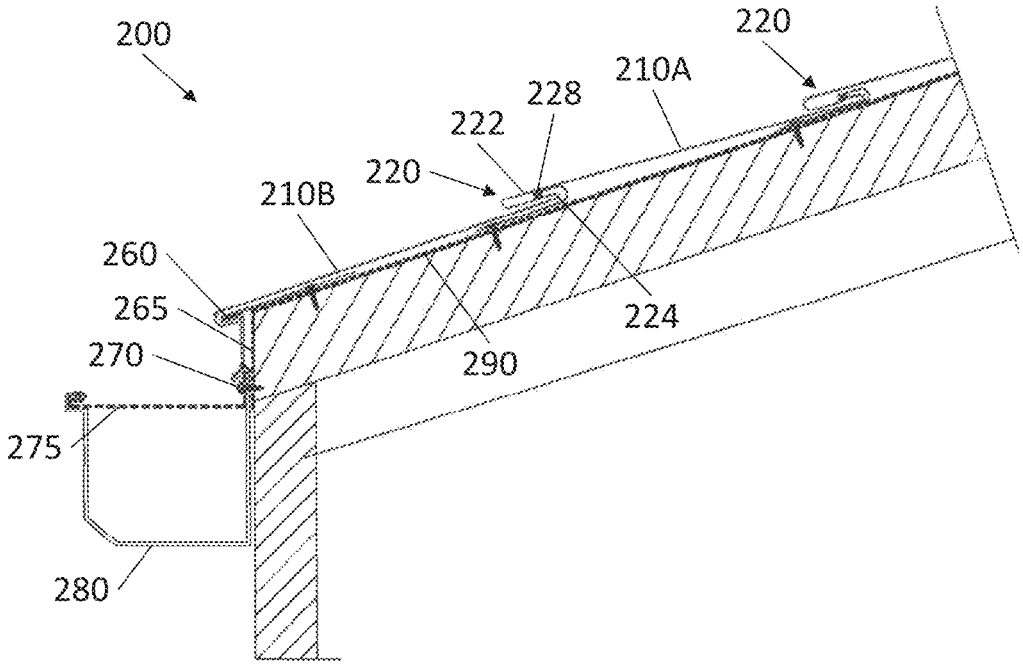
FIG. 2 is a cross-sectional view of an example sloped roof with roofing panels according to the present disclosure attached down to the facia of the roof.

FIG. 2 is a cross-sectional view of an example sloped roof 200 with a first panel 210A and a second panel 210B coupled to a base surface 250 and secured to each other via coupling 220. In FIG. 2, second panel 210B extends downward from the first panel 210A to an eave trim 260 of the roof 200. The downward edge of the second panel 210B may wrap around the eave trim 260. By wrapping the downward edge of the second panel around the eave trim 260, moisture can be prevented from traveling up under the second panel 210B or any panel located proximate the eave trim 260. In some examples, eave trim 260 can include a drip edge. In other examples the eave trim can have an integrated drip edge. The drip edge in any of the examples can also help prevent water from getting under a panel. FIG. 2 further includes a generic gutter 280 support by a gutter hanger 275 coupled to the roof 200 via a fastener 270. The generic gutter 280 can transport water away from the roof 200.

FIG. 2 also includes an underlayment 290 which is located above the base surface 250 and below the panels 210A/B. The underlayment 290 can wrap over the bottom edge of the roof to a point on the side of the building as shown by 265. The underlayment 290 can be made of a material that is resistant to water and in some examples, resistant to high temperatures (e.g. 240° F.). In some examples, the underlayment 250 can be self-adhering to the base surface 250, with one example being the Englert® Metalman HT underlayment. The underlayment 290 can be a secondary barrier for preventing water from damaging the base surface 250 due to being under the panels and its water resistance.

Continuing with the example of FIG. 2, coupling 220 includes a receptacle 222 of the first panel 210A and a hook portion of the second panel 210B. The receptacle 222 is located proximate the downward edge of the first panel 210A and the hook portion is located proximate the upward edge of the second panel 210B, as described later in this disclosure. The coupling 220 further includes a sealant 228 located between the receptacle portion 222 and the hook portion. The sealant 228 can be any water-resistant material (e.g. butyl) and can prevent water from entering the coupling 220 between the first panel 210A and the second panel 210B. Element 420 of FIG. 2 points to an example coupling between two panels and an enlarged view of said coupling will be discussed later in this disclosure.

Figure 3A:
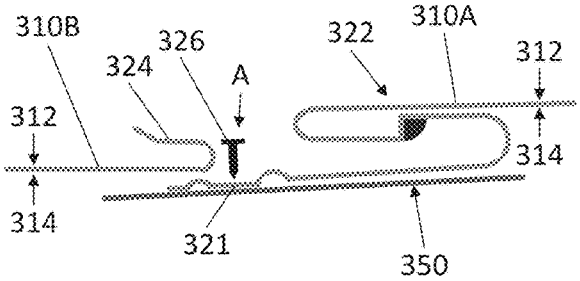
FIG. 3A is a cross sectional view of an example of a first panel with a receptacle and a second panel with a hook portion.

FIG. 3A is a cross-sectional view of an example first panel 310A with a receptacle 322 and a second panel 310B with a hook portion 324. The first panel 310A and the second panel 310B each have an inward face 314, which faces the base surface 350, and an outward face 312, opposite the inward face, which faces away from the base surface. An end portion of the first panel 310A is folded such that the outward face 312 of the first panel 310A faces toward the base surface, thereby creating the receptacle 322. In a similar manner, an end portion of the second panel 310B is bent such that the inward face 314 of the second panel 310B faces away from the base surface, thereby creating the hook portion 324.

Continuing with the example of FIG. 3A, a nail strip 321 extends from the receptacle 322 of the first panel 310A toward the hook portion 324 of the second panel 310B. A nail 326 is positioned to engage the nail strip 321 to fasten it to the base surface 350 of the roof in direction A. Although a nail is depicted, a person skilled in the art will understand other fasteners can be used. In some examples, nail strip 321 can have pre-drilled holes which can provide a guide for nails, allowing for quicker installation and aiding in securing the first panel to the base surface. Additionally, nail strip 321 can have multiple raised portions on either side of a flat portion, which can aid a user in determining where to use a fastener to fasten the panel to the base surface 350.

Figure 3B:
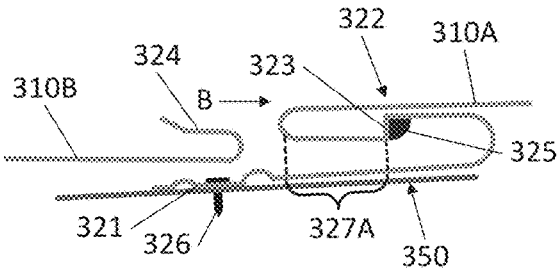
FIG. 3B is the cross-sectional view of the example of FIG. 3A with the first panel secured to the base surface.

FIG. 3B is the cross-sectional view of the example of FIG. 3A with the first panel 310A secured to the base surface 350 via the nail 326 in the nailing strip 321. The receptacle 322 of the first panel 310A includes an entry portion 327A. The hook portion 324 of the second panel 310B is in the process of moving in direction B, toward the entry portion 327A of the receptacle 322 of the first panel 310A. At this point, the hook portion 324 is in a fully uncompressed state.

Continuing with the example of FIG. 3B, the receptacle 322 includes a shoulder 323. Shoulder 323 is at the upward end of the entry portion 327A. Shoulder 323 separates the entry portion 327A from a retaining portion 327B. Sealant 325 is applied to shoulder 323. Sealant 325 can be any sealing material, however in some examples, sealant 325 is water resistant butyl.

Figure 3C:
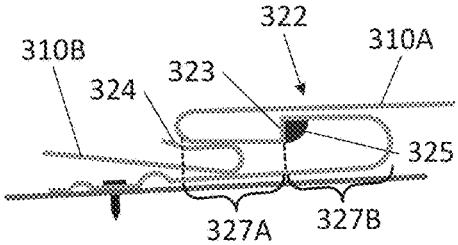
FIG. 3C is the cross-sectional view of the example of FIG. 3B with a hook portion of the second panel being inserted into the receptacle of the first panel.

FIG. 3C is the cross-sectional view of the example of FIG. 3B with the hook portion 324 of the second panel 310B partially inserted into the entry portion 327A of the receptacle 322. In FIG. 3C, the hook portion 324 of the second panel 310B is compressed by some amount while in the entry portion 327A of the receptacle 322. The hook portion 324 can be inserted straight into the receptacle 322, or alternatively, the hook portion 324 can be inserted at an angle into the receptacle 322. By inserting the hook portion 324 at an angle, the force to insert the hook portion into the receptacle 322 can be decreased. Receptacle 322 further contains retaining portion 327B upward of entry portion 327A. Retaining portion 327B is separated from entry portion 327A by shoulder 323. Retaining portion 327B extends further outward from the base surface than the entry portion 327A. Sealant 325 can be located in any part of retaining portion 327B, and in some examples, sealant 325 extends from shoulder 323 to less than a half of the retaining portion volume.

Figure 3D:
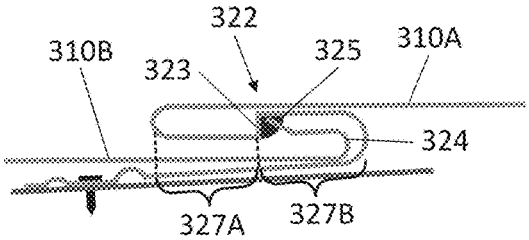
FIG. 3D the cross-sectional view of the example of FIG. 3C with the hook portion of the second panel secured within the receptacle of the first panel.

FIG. 3D is the cross-sectional view of the example of FIG. 3C with the hook portion 324 of the second panel 310B fully inserted into receptacle 322 of the first panel 310A. Because the retaining portion 327B of the receptacle 322 extends further outward from the base surface than the entry portion 327A, hook portion 324 can expand to a mostly uncompressed state. Hook portion 324 is engaged with the sealant 325 located on shoulder 323 and partially disposed in retaining portion 327B. Shoulder 323 and sealant 325 aid in preventing the hook portion 324, being in a mostly uncompressed state, from dislodging from receptacle 322, effectively securing the second panel 310B to the first panel 310A. By securing second panel 310B to first panel 310A, a water-resistant barrier can be formed, thereby protecting the underlying structure from water damage.

FIG. 3A-FIG. 3D depict an example of interlocking panels in various stages of installation. For example, a user can first secure a first panel 310A to a base surface 350 as in the example of FIG. 3B. In some examples, the first panel is secured to the base surface via nail 326 in a nail strip 321. The first panel 310A can comprise a receptacle 322 which has an entry portion 327A and a retaining portion 327B separated by a shoulder 323. In some examples, the retaining portion 327B is wider than the entry portion 327A. A user can then secure a second panel 310B to the first panel 310A by inserting a hook portion 324 of the second panel 310B into the receptacle 322 of the first panel 310A. In some examples, as the hook portion 324 is inserted into the receptacle 322, the hook portion is compressed upon entering the entry portion 327A of the receptacle 322 as in the example of FIG. 3C. A user can further insert hook portion 324 into the receptacle 322 such that it passes the shoulder 323 of the receptacle 322 into the retaining portion 327B of the receptacle 322. At this point, hook portion 324 can release to one of an uncompressed state, and a state that is less compressed than when the hook portion is in the entry portion 327A of the receptacle 322. The second panel 310B can therefore be interlocked with the first panel 310A. In some examples, second panel 310B, after being secured to first panel 310A, is secured to the base surface 350. This method can be repeated in order to cover an area such as a roof.

In some examples, the hook portion 324 can engage (e.g. compress) a sealant 325 located on the shoulder 323 of the receptacle as in the example of FIG. 3D. The sealant 325 can be pre-applied or alternatively the sealant can be applied at any stage when securing the first panel and the second panel. In some examples, the sealant is applied to the shoulder of the receptacle before securing the second panel to the first panel. The engagement between the hook portion, sealant 325, and the shoulder 324 can provide a water-resistant seal between the first panel and the second panel.

The example steps of installing the panels as provided in FIG. 3A-FIG. 3D can be repeated. In some examples, a user can secure a first panel to a base surface at a first point. Subsequently, the user can secure a second panel to each of the first panel and the base surface at a second point. In some examples, the second point is below the first point, toward the eaves of a structure. In this way, a user can install panels for a roof in a top-down manner; from a peak of a structure to the eaves of the structure. One advantage of installing panels in a top-down manner is that a user can avoid contacting a panel that was previously secured to the base surface. By not contacting the already installed panels, possible damage from said contact can be avoided. An additional/alternative advantage by installing the panels in a top-down manner is that the installation can take less time than it would take to install the panels in a bottom-to-top fashion.

In some examples, a portion of a roofing panel can hang over an edge of the base surface which can be undesirable. In these examples, a user can remove a portion of the panel which hangs over the edge of the base structure. The remaining portion of the panel can then be bent over the edge of the base surface to aid in protecting the base surface from moisture ingress.

Figure 4:
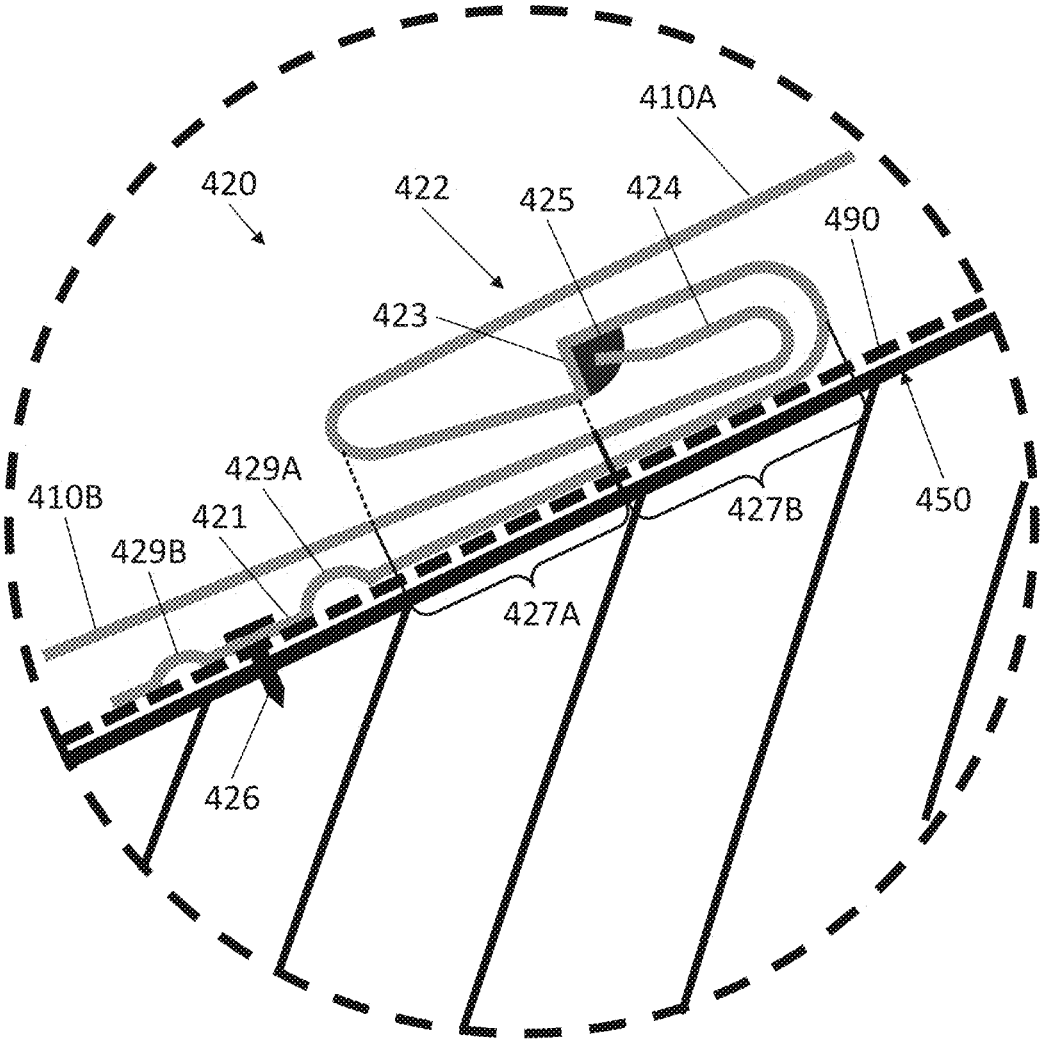
FIG. 4 is an enlarged, cross-sectional view of an example installed coupling as shown in FIG. 2.

FIG. 4 is an enlarged, cross-sectional view of an example installed coupling as shown in FIG. 2 (e.g. element 420). The first panel 410A and the second panel 410B are secured to each other and are secured to the base surface 450. Underlayment 490 is a layer between the panels and the base surface 450 which can be water resistant and heat resistant which can further protect the base surface 450.

Figure 5A:
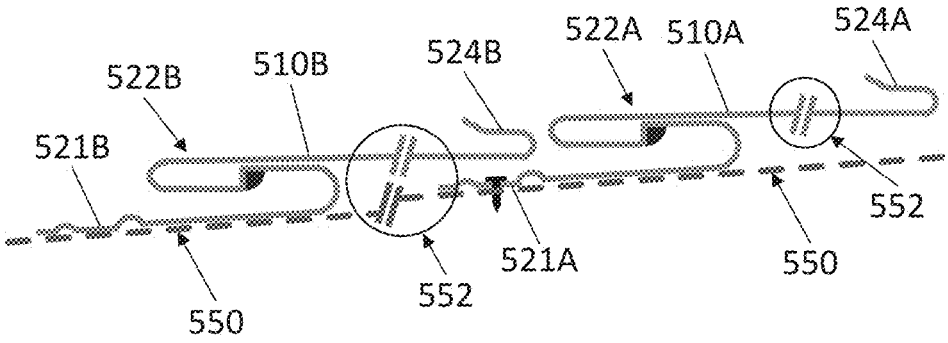
FIG. 5A is a cross-sectional view of an example of an entire first panel and an entire second panel.

FIG. 5A is a cross-sectional view of an example of an entire first panel 510A and an entire second panel 510B. First panel 510A is secured to base surface 550 while second panel 510B is not secured to anything. First panel 510A includes a first nail strip 521A, a first receptacle 522A, and a first hook portion 524A. Second panel 510B includes a second nail strip 521B, a second receptacle 522B, and a second hook portion 524B. First panel 510A and second panel 510B each further include a generally flat portion between their respective hook portions and receptacles. For example, first panel 510A includes a generally flat portion between receptacle 522A and hook portion 524A. The generally flat portion extends for a length that is substantially greater than a length of the first receptacle 522A. For illustration purposes, the generally flat portion has been mostly excluded from FIG. 5A. Instead, break lines 522 show that the generally flat portion extends in a similar manner as already shown. Break lines 522 also show that the base surface 550 extends in a substantially similar manner as already shown (e.g. in a constant slope). Base surface 550 can have a constant slope, or alternatively, base surface can have a slope that varies over a distance.

Continuing with FIG. 5A, first panel 510A and second panel 510B contain substantially the same structural design and are interchangeable. For example, first panel 510A can be swapped with second panel 510B such that first panel 510A becomes second panel 510B and second panel 510B becomes first panel 510A.

Figure 5B:
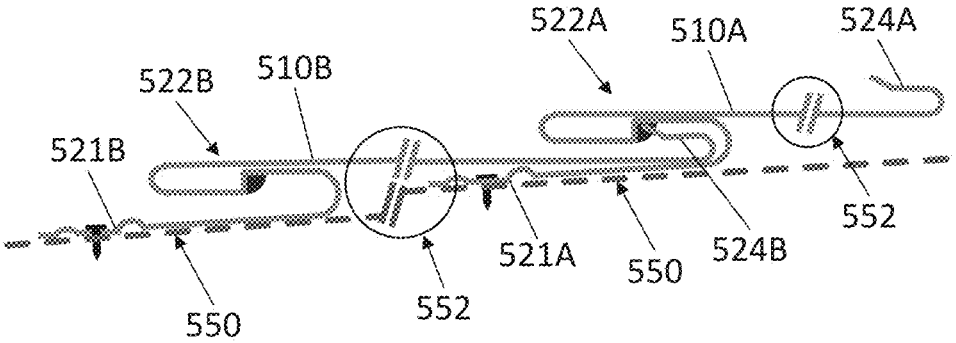
FIG. 5B is a cross-sectional view of the example of FIG. 5A with the entire first panel and the entire second panel secured to each other and a base surface.

FIG. 5B is a cross-sectional view of the example of FIG. 5A with the entire first panel 510A and the entire second panel 510B secured to each other and the base surface 550. First panel 510A is secured to the base surface 550 via a fastener in the first nail strip 521A. Similarly, second panel 510B is secured to the base surface 550 via a fastener in the second nail strip 521B. Additionally, the second hook portion 524B is engaged with the first receptacle 522A, thereby securing the second panel 510B to the first panel 510A. Further panels, not shown in FIG. 5A nor FIG. 5B, can similarly be attached to the first panel 510A and the second panel 510B as well as to the base surface 550. In some examples, panels 510A, 510B, and further panels can cover an entire structure, thereby creating a roof which can protect the structure from the elements and in particular, ingress of water.

Various examples have been described. These and other examples are within the scope of the following numbered embodiments.

The invention claimed is:

1. An interlocking panel system for covering a base surface comprising:

a first panel configured to cover a portion of the base surface and including a receptacle, the receptacle comprising:

an entry portion; and a retaining portion separated from the entry portion by a shoulder, the retaining portion being wider than the entry portion;

a second panel configured to cover a portion of the base surface and including a hook portion, the hook portion comprising:

a bend formed proximate to an end of the second panel;

a first section extending from the bend, the first section being shorter than the entry portion; and a second section extending from and at an angle relative to, the first section, the angle being such that the second section extends outwardly of the first section relative to the base surface, the second section being shorter than the first section, the hook portion configured to be inserted into the receptacle of the first panel, the hook portion being compressed upon entering the entry portion of the receptacle and expanding upon passing the shoulder into the retaining portion, an end of the second section, when expanded into the retaining portion, engaging the shoulder of the first panel and preventing the hook portion from being withdrawn from the retaining portion.

2. The interlocking panel system of claim 1, wherein the receptacle of the first panel is located proximate a downward edge of the first panel, and wherein the hook portion of the second panel is located proximate to an upward edge of the second panel.

3. The interlocking panel system of claim 1, wherein the first panel and the second panel each comprise a single sheet of rigid material.

4. The interlocking panel system of claim 1, wherein the hook portion is configured to extend a first width, the first width wider than a width of the entry portion of the receptacle, when the hook portion is in an uncompressed state;

wherein the hook portion is configured to extend a second width, the second width being less than or equal to the width of the entry portion of the receptacle when the hook portion is compressed upon entering the entry portion of the receptacle, and wherein the hook portion is further configured to extend a third width, the third width greater than the second width and less than or equal to the first width, when the hook portion passes the shoulder and enters the retaining portion of the receptacle.

5. The interlocking panel system of claim 1, wherein the first panel and the second panel are capable of extending across and covering a pitched roof having a lateral extent from a first edge to a second edge, an eave, and a peak, the portion of the pitched roof sloping downward from the peak to the eave, the first panel and the second panel each extending from the first edge to the second edge.

6. The interlocking panel system of claim 1, wherein the first panel and the second panel further comprise an inward face and an outward face opposite the inward face, the inward face configured to face toward the base surface and the outward face configured to face away from the base surface.

7. The interlocking panel system of claim 6, wherein the hook portion of the second panel is configured such that the inward face of the second panel faces away from the base surface.

8. The interlocking panel system of claim 6, wherein the receptacle comprises a folded body defining an opening, the folded body comprising the retaining portion and configured such that the outward face of the first panel faces toward the base surface.

9. The interlocking panel system of claim 8, wherein the folded body is configured to receive the hook portion of the second panel.

10. The interlocking panel system of claim 1, wherein the first panel further comprises a nail strip, the nail strip extending from the receptacle, the nail strip configured to aid in securing the first panel to the base surface.

11. The interlocking panel system of claim 10, wherein the hook portion of the second panel overlaps the nail strip of the first panel.

12. The interlocking panel system of claim 1, wherein the first panel comprises a second hook portion, and wherein the second panel comprises a second receptacle, the second receptacle comprising a second entry portion and a second retaining portion separated by a second shoulder, wherein the second retaining portion is wider than the second entry portion.

13. The interlocking panel system of claim 12, wherein the first panel comprises a sheet-like portion between the receptacle and the second hook portion, and wherein the second panel comprises a second sheet-like portion between the hook portion and the second receptacle.

14. A method of installing panels to a base surface, the method comprising:

securing a first panel to the base surface, the first panel comprising a receptacle, the receptacle comprising:

an entry portion; and a retaining portion separated from the entry portion by a shoulder, the retaining portion being wider than the entry portion;

securing a second panel to the first panel by inserting a hook portion of the second panel into the receptacle of the first panel, the hook portion comprising:

a bend formed proximate to an end of the second panel;

a first section extending from the bend, the first section being shorter than the entry portion; and a second section extending from and at an angle relative to, the first section, the angle being such that the second section extends outwardly of the first section relative to the base surface, the second section being shorter than the first section;

wherein when the hook portion is inserted into the receptacle, the entry portion compresses a width of the hook portion, the compression of the hook portion being released upon the hook portion passing the shoulder and entering the retaining portion of the receptacle, the end of the second section, when expanded into the retaining portion, engaging the shoulder of the first panel and preventing the second panel from being withdrawn from the first panel.

15. The method of claim 14, wherein securing the first panel to the base surface comprises securing a nail strip of the first panel to the base surface, the nail strip being located downwardly of the receptacle of the first panel.

16. The method of claim 14, wherein securing the first panel to the base surface comprises securing the first panel to the base surface at a first point, and wherein securing the second panel to the first panel comprises securing the second panel to the first panel at a second point located downwardly from the first point.

17. The method of claim 14, wherein securing the first panel to the base surface occurs before securing the second panel to the first panel.

18. The method of claim 14, further comprising removing a portion of the second panel and wrapping an edge of the remaining second panel over a downward edge of the base surface.

19. The method of claim 14, wherein securing the second panel to the base surface comprises securing a nail strip of the second panel to the base surface, the nail strip being located downwardly of a second receptacle of the second panel.

20. The method of claim 14, wherein the base surface is a portion of a pitched roof having a lateral extent from a first edge to a second edge, an eave, and a peak, the portion of the pitched roof sloping downward from the peak to the eave, the first panel and the second panel each extending from the first edge to the second edge.

21. The method of claim 20, further comprising securing additional panels, in succession, to a previously secured panel, until enough additional panels are secured such that the eave is covered by one of the additional panels.

22. The method of claim 20, wherein the first panel is secured to the base surface before the second panel is secured to the first panel, the first panel being secured to the base surface such that the first panel is closer to the peak than the second panel.

23. The method of claim 22, further comprising securing a third panel to the second panel after the second panel is secured to the first panel, the third panel being secured such that the first panel and the second panel are closer to the peak than the third panel.

24. The interlocking panel system of claim 1, wherein the first panel further comprises a sealant, the sealant located on at least one of the shoulder and the retaining portion.

25. The method of claim 14, further comprising applying a sealant to the first panel on at least one of the should and the retaining portion.

26. The method of claim 25, wherein the end of the second section, when expanded into the retaining portion, further engages the sealant of the first panel and provides a watertight seal between the first panel and the second panel.

* * * * *